US010220493B2

(12) United States Patent
Seith et al.

(10) Patent No.: US 10,220,493 B2
(45) Date of Patent: Mar. 5, 2019

(54) SPINDLE LOCK MECHANISM FOR PNEUMATIC RIGHT-ANGLE IMPACT TOOL

(71) Applicant: INGERSOLL-RAND COMPANY, Davidson, NC (US)

(72) Inventors: Warren A. Seith, Bethlehem, PA (US); Aaron Crescenti, Glen Gardner, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 351 days.

(21) Appl. No.: 15/256,949

(22) Filed: Sep. 6, 2016

(65) Prior Publication Data

US 2018/0065233 A1 Mar. 8, 2018

(51) Int. Cl.
*B25B 21/02* (2006.01)
*B25F 5/00* (2006.01)

(52) U.S. Cl.
CPC ..... *B25B 21/02* (2013.01); *B25F 5/001* (2013.01)

(58) Field of Classification Search
CPC . B25F 5/001; B25F 5/02; B25F 5/008; B23Q 5/04; B23Q 5/045; B25B 21/02; B25B 21/00; A01G 3/053; A01G 3/062; A01G 3/086
USPC ..... 173/29, 39–41, 213, 216, 170–171
See application file for complete search history.

(56) References Cited

U.S. PATENT DOCUMENTS

| | | | | |
|---|---|---|---|---|
| 3,687,179 | A * | 8/1972 | Totsu | B25B 21/00 81/436 |
| 3,807,815 | A * | 4/1974 | Kasabian | B23Q 1/265 384/517 |
| 3,901,098 | A * | 8/1975 | Jinkins | B23Q 5/045 173/216 |
| 4,804,048 | A | 2/1989 | Porth, Jr. | |
| 5,016,501 | A * | 5/1991 | Holzer, Jr. | B25B 21/00 173/181 |
| 5,788,021 | A | 8/1998 | Tsai | |
| 6,273,200 | B1 | 8/2001 | Smith et al. | |
| 6,454,020 | B1 | 9/2002 | Jong | |
| 7,717,192 | B2 * | 5/2010 | Schroeder | B25D 16/006 173/104 |

(Continued)

*Primary Examiner* — Robert Long
(74) *Attorney, Agent, or Firm* — Jones IP Group; Wayne A. Jones

(57) ABSTRACT

A power tool is provided that includes a motor housing, an output head, a pinion, at least one pin, and at least first and second rings. The output head includes a rotatable output spindle and extends from the motor housing which extends longitudinally along a first axis. The pinion is located in the output head, is coupled to a drive force, and rotates about the first axis to rotate the rotatable output shaft. The at least one pin is located in the output head. The first ring is coupled to the pinion and rotatable about the first axis with the pinion. The second ring engages, and is movable longitudinally along the first axis relative to, the at least one pin. The second ring is not rotatable about the first axis. Rather, the second ring is movable toward and away from the first ring along the first axis, and selectively engagable with the first ring. Engagement between the first and second rings prevents the first ring from rotating with respect to the first axis which prevents the pinion from rotating which prevents the rotatable output spindle from rotating.

20 Claims, 12 Drawing Sheets

(56) References Cited

U.S. PATENT DOCUMENTS

| | | | | |
|---|---|---|---|---|
| 7,900,715 | B2 * | 3/2011 | Chen | B23B 45/008 173/176 |
| 8,191,649 | B2 | 6/2012 | Zhu | |
| 8,397,831 | B2 | 3/2013 | Wan et al. | |
| 8,561,717 | B2 | 10/2013 | Pozgay et al. | |
| 8,584,770 | B2 | 11/2013 | Zhang et al. | |
| 8,651,198 | B2 | 2/2014 | Ito | |
| 9,233,461 | B2 * | 1/2016 | Tomayko | B25F 5/001 |
| 9,956,676 | B2 * | 5/2018 | Wong | B25B 21/00 |
| 2006/0086514 | A1 * | 4/2006 | Aeberhard | B25B 21/00 173/48 |
| 2007/0201748 | A1 * | 8/2007 | Bixler | B25F 5/001 382/225 |
| 2011/0214892 | A1 * | 9/2011 | Hecht | B25B 21/00 173/164 |
| 2011/0232930 | A1 * | 9/2011 | Zhang | B25F 5/001 173/178 |
| 2011/0266014 | A1 * | 11/2011 | McRoberts | B25F 5/02 173/170 |
| 2013/0056235 | A1 * | 3/2013 | Pozgay | B25B 21/00 173/29 |
| 2013/0140050 | A1 * | 6/2013 | Eshleman | B25B 21/00 173/1 |
| 2013/0228354 | A1 | 9/2013 | Timmons | |
| 2013/0284478 | A1 | 10/2013 | Saur | |
| 2014/0202725 | A1 | 7/2014 | Johnson | |
| 2014/0296020 | A1 * | 10/2014 | Chen | F16H 1/28 475/269 |

* cited by examiner

SPINDLE LOCK MECHANISM FOR PNEUMATIC RIGHT-ANGLE IMPACT TOOL

TECHNICAL FIELD AND SUMMARY

The present disclosure relates, generally, to an angle impact tool, and more particularly, to an angle impact tool which includes a lock feature that selectively and rigidly fixes the tool's output.

Impact driver tools are popular with mechanics and technicians due to their ability to quickly tighten or remove fasteners at high torque. In certain circumstances however, it may be difficult for a user to determine the exact torque to apply. This is particularly the case during fastening operations where the final tightening torque may be critical to setting the correct clamp load required for a joint. Accordingly, including a spindle lock feature on a right-angle impact tool may be used to perform a "final tightening" step when installing a fastener.

In addition, a right-angle impact tool may benefit from acting as a non-powered "breaker bar" type tool. Using the right-angle impact tool as a breaker bar tool may allow it to be able to loosen a stubborn fastener. For instance, the user may manually "break" the static friction of the fastener using handle leverage and manually applied force. This is so long as the output spindle is locked.

A right angle tool that may be improved is of a type disclosed in U.S. Patent Publication No. 20090272556, Angle Head and Bevel Gear for Tool, Publication Date Nov. 5, 2009, the disclosure of which is incorporated in its entirety herein by reference.

Accordingly, an illustrative embodiment of the present disclosure provides a pneumatic angled impact tool that includes a lock mechanism configured to selectively hold or release the tool's output spindle. By locking the output spindle, the tool may be used as a wrench having the ability to tighten or loosen fasteners. This first illustrative embodiment includes upper and lower dog rings that when engaged with each other hold the tool's pinion preventing it from rotating, and thereby preventing the tool's output spindle from rotating. When the upper and lower dog rings are released from each other, the pinion becomes free to rotate again, thereby freeing the output spindle to rotate as well. Illustratively, the lower dog ring may be press-fit onto the pinion's shaft so that the lower dog ring rotates with the pinion. The upper dog ring is axially moveable with respect to the lower dog ring and pinion to either engage or disengage the lower dog ring. Pins or other like structure(s) may be inserted into the housing of the impact tool and engage the upper dog ring to provide a path of travel for same. Spring loaded engagement screws, for example, may be attached to the upper dog ring to assist moving same between the engaged and disengaged positions. Such springs may bias the upper dog ring to the disengaged position. A manual or mechanical force may be applied to the engagement screws attached to the upper dog ring to move same towards the lower dog ring opposite the bias from the springs along the path of travel defined by the pins. Alternatively, the upper dog ring may also be moved using a shifting fork or like structure. The shifting fork may engage a portion of the upper dog ring to move it axially. For example, the outside diameter of the upper dog ring may be increased to extend beyond the pins and engage the shifting fork. This allows an operator to move the ring by moving the shifting fork.

Engagement features such as castellated teeth on the upper dog ring may mate with receiving depressions on the lower dog ring (and vice-versa) keeping the upper and lower dog rings secure to each other. This is further reinforced by the pins along which the upper dog ring travels. These pins also prevent the upper dog ring from rotating about the axis of the tool so when engaged with the lower dog ring (which rotates with the pinion) the upper dog ring prevents both the lower dog ring and the pinion from rotating until disengagement between the two rings.

Another illustrative embodiment of the present disclosure includes an alternate lock mechanism for the same angled impact tool. This embodiment includes a rotatable lock selector ring that is accessible by the user to selectively lock or unlock the output spindle. In this embodiment the lock selector ring may be rotated about the central axis of the tool in either clockwise or counterclockwise motions to lock or release the output spindle. The selector ring includes an exterior surface accessible by the user to rotate it. Ramp surfaces on the lock selector ring, illustratively located in the interior of the power tool, effectuate the movement of structures linearly parallel to the central axis of the tool while the lock selector ring rotates about that axis. Push rods or like structures are inserted in the tool and configured to be pushed forward or reverse by the ramps on the lock selector ring. A shuttle bushing is configured to be located about the pinion and does not rotate to drive the output spindle. A spring biases against a flange portion of the shuttle bushing to push it axially along the central axis of the impact tool towards a disengaged position with respect to the pinion. In other words, the default state of the pinion, and therefore the output spindle, is to freely rotate under a no-power condition. That said, when lock selector ring is rotated to move the ramp surfaces which push the rods forward, the shuttle bushing is pushed forward against the bias of the spring.

In this embodiment, the pinion is outfitted with external dog features about the periphery of same configured to selectively mate with internal dog features on the shuttle bushing. Accordingly, when the shuttle bushing is moved forward along the central axis, its internal dog features mate with the external dog features on the pinion. This engagement causes the pinion to be held by the shuttle bushing. Illustratively, one or more splines on the housing may engage the shuttle bushing to prevent same from rotating with respect to the impact tool. Therefore, since the shuttle bushing cannot rotate about the tool's central axis, when the external dogs on the pinion engage the internal dogs on the shuttle bushing, the pinion cannot rotate either. And, thus, by locking the pinion in place, the output spindle is prevented from rotating as well.

Another illustrative embodiment of the present disclosure provides a power tool comprising a motor housing, an angled head, a pinion, a bushing, and at least first and second rings. The angled head includes a rotatable output spindle and extends from the motor housing. The motor housing extends longitudinally along a first axis and the rotatable output spindle of the angled head extends longitudinally along a second axis located non-parallel to the first axis. The pinion is located in the angled head and has a first end portion and a second end portion. The first end portion is coupled to a drive force on the first axis and the second end portion includes a plurality of gear teeth that rotate about the first axis to rotate the rotatable output shaft. The bushing is located in the angled head and supports the pinion. The at least one pin is located in the angled head. The first ring is coupled to the pinion and rotatable about the first axis with the pinion. The second ring engages, and is movable longitudinally along the first axis relative to, the at least one pin. The second ring is not rotatable about the first axis. The first ring includes a castellated surface having alternating pluralities of teeth and depressions. The second ring includes a castellated surface having alternating pluralities of teeth and depressions and is movable toward and away from the first ring along the first axis. The pluralities of teeth and depressions of the second ring selectively engage corresponding pluralities of teeth and depressions of the first ring when the second ring is moved toward and engages the first ring. Engagement between the first and second rings prevents the first ring from rotating with respect to the first axis which prevents the pinion from rotating which prevents the rotatable output spindle from rotating. The pluralities of teeth and depressions of the second ring selectively disengage the pluralities of teeth and depressions of the first ring when the second ring is moved away from and disengages the first ring. Disengagement between the first and second rings allows the first ring to rotate with respect to the first axis which allows the pinion to rotate which allows the rotatable output spindle to rotate.

In the above and other embodiments, the power tool may also comprise: the at least one pin being a plurality of pins, wherein each of the plurality of pins being located concentrically about the first axis and extend longitudinally parallel to the first axis, wherein the second ring includes a plurality of pin slots each located about the second ring and each of the plurality of pins being located in one of the plurality of pin slots; wherein the power tool being a right-angle impact tool; the motor housing supports a pneumatic motor; the first axis being oriented perpendicular to the second axis; the pinion includes a key at the second end portion configured to engage a key slot on the first ring so the first ring will rotate with the pinion when the pinion rotates; a cap configured to secure onto the angled head opposite the output spindle; the first ring having a smaller diameter than the second ring; at least one second pin being coupled to the second ring to move the second ring longitudinally along the first axis relative to the at least one pin.

Another illustrative embodiment of the present disclosure provides a power tool comprising a motor housing, an output head, a pinion, at least one pin, and at least first and second rings. The output head includes a rotatable output spindle and extends from the motor housing which extends longitudinally along a first axis. The pinion is located in the output head, is coupled to a drive force, and rotates about the first axis to rotate the rotatable output shaft. The at least one pin is located in the output head. The first ring is coupled to the pinion and rotatable about the first axis with the pinion. The second ring engages, and is movable longitudinally along the first axis relative to, the at least one pin. The second ring is not rotatable about the first axis. Rather, the second ring is movable toward and away from the first ring along the first axis, and selectively engagable with the first ring. Engagement between the first and second rings prevents the first ring from rotating with respect to the first axis which prevents the pinion from rotating which prevents the rotatable output spindle from rotating. Conversely, disengagement between the first and second rings allows the first ring to rotate with respect to the first axis which allows the pinion to rotate which allows the rotatable output spindle to rotate.

In the above and other embodiments, the power tool may also comprise: the rotatable output spindle extends longitudinally along a second axis located perpendicular to the first axis; the first ring includes a castellated surface having alternating pluralities of teeth and depressions; the second ring includes a castellated surface having alternating pluralities of teeth and depressions; and the pluralities of teeth and depressions of the second ring selectively engage the pluralities of teeth and depressions of the first ring when the second ring is moved toward and engages the first ring.

Another illustrative embodiment of the present disclosure provides a power tool comprising a motor housing, an angled head, a pinion, a selector, a bushing, and a spring. The angled head includes a rotatable output spindle and extends from the motor housing. The motor housing extends longitudinally along a first axis and the rotatable output spindle of the angled head extends longitudinally along a second axis located non-parallel to the first axis. The pinion is located in the angled head and having a first end portion and a second end portion. The first end portion of the pinion is coupled to a drive force on the first axis and the second end portion includes a plurality of gear teeth that rotate about the first axis to rotate the rotatable output shaft that extends longitudinally along the second axis. The selector is located on the exterior of the power tool and is movable to forward, reverse, and lock positions of the rotatable output spindle. The selector further includes a face located transverse to the first axis and is configured to include at least one ramp surface. Accordingly, moving the selector causes the at least one ramp surface to also move. The at least one ramp surface is configured to be angled towards the pinion. The pinion further includes at least one tooth that extends from the pinion. The bushing includes a bore disposed there through and configured to receive the pinion. The bushing also includes at least one recess configured to receive the at least one tooth from the pinion. The bushing is movable longitudinally along the first axis but not rotatable about the first axis. At least one push rod is configured to fit onto the at least one ramp surface on the selector and engage the bushing. Accordingly, movement of the selector moves the ramp which moves the at least one push rod to move the bushing to engage the pinion. When the at least one tooth on the pinion engages the at least one recess in the bushing the pinion is not able to rotate. The spring is configured to bias against the bushing to keep the at least one tooth and at the least one recess separated when the selector has not pushed the at least one push rod against the bushing to move the bushing against the pinion.

In the above and other embodiments, the power tool may also comprise: the at least one tooth being a plurality of teeth and the at least one recess is a plurality of recesses; the pinion, bushing, and the at least one push rod are longitudinally movable along the first axis; the selector being a ring configured to rotate about the first axis; wherein rotating the selector ring in a first direction moves the at least one push rod to move the bushing against the pinion to prevent the pinion from rotating; and the at least one ramp surface being a plurality of ramp surfaces, wherein the at least one push rod being a plurality of push rods wherein the plurality of push rods are configured to be moved by the plurality of ramp surfaces to move the bushing against the pinion to prevent the pinion from rotating.

Additional features of the present disclosure will become apparent to those skilled in the art upon consideration of illustrative embodiments including the best mode of carrying out the disclosure as presently perceived.

DETAILED DESCRIPTION OF THE DRAWINGS

Figure 1:
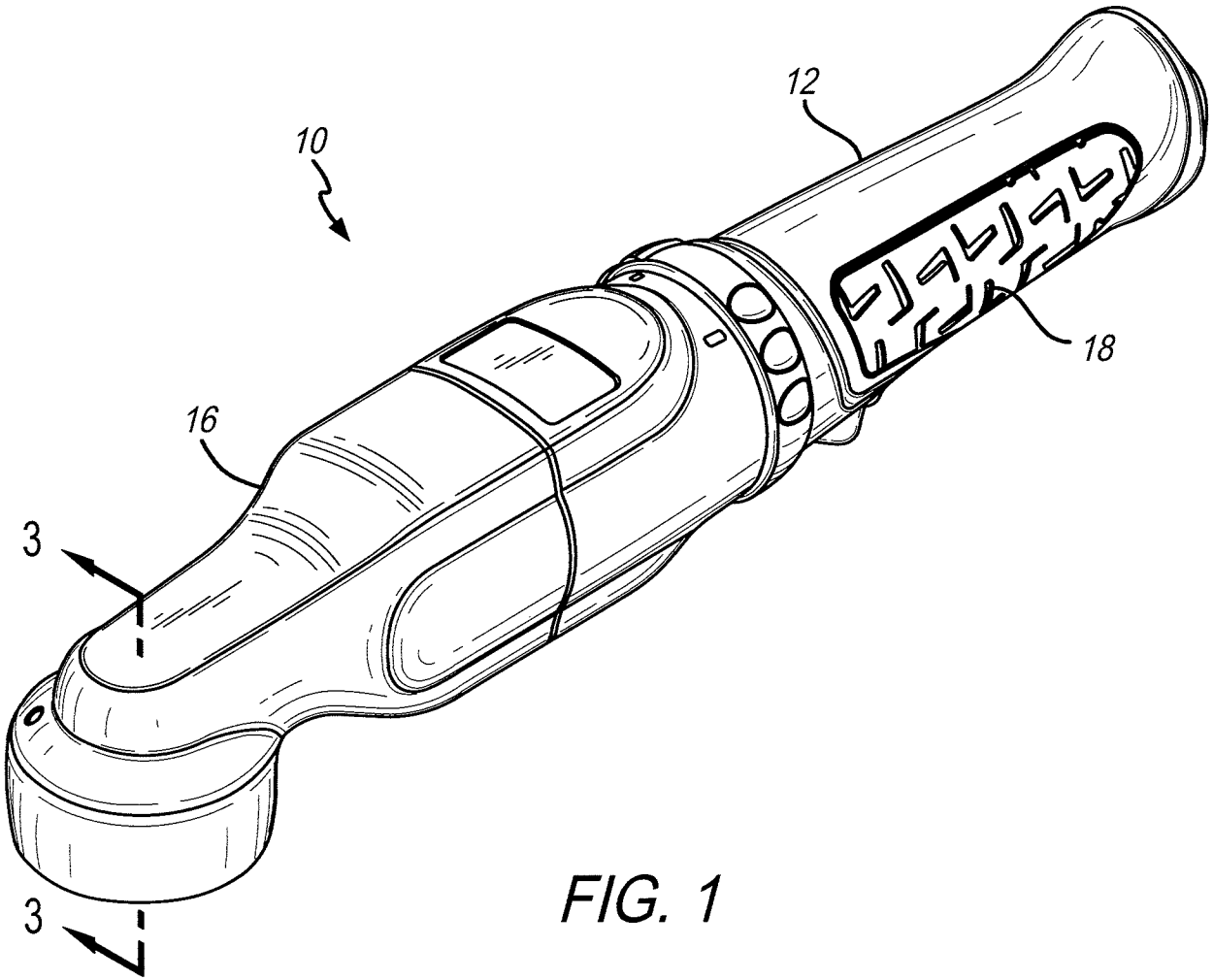
FIG. 1 is a perspective view of a power tool.

A perspective view of power tool 10 is shown in FIG. 1. It is appreciated that power tool 10 may be a rotary tool of the type including, for example, a screwdriver, a drill, etc., Power tool 10 illustratively includes a motor housing 12. A motor (not shown), such as a pneumatic motor is supported within motor housing 12. An angle head 16 is coupled to motor housing 12. A handle grip 18 is formed on the outside of motor housing 12.

Figure 2:
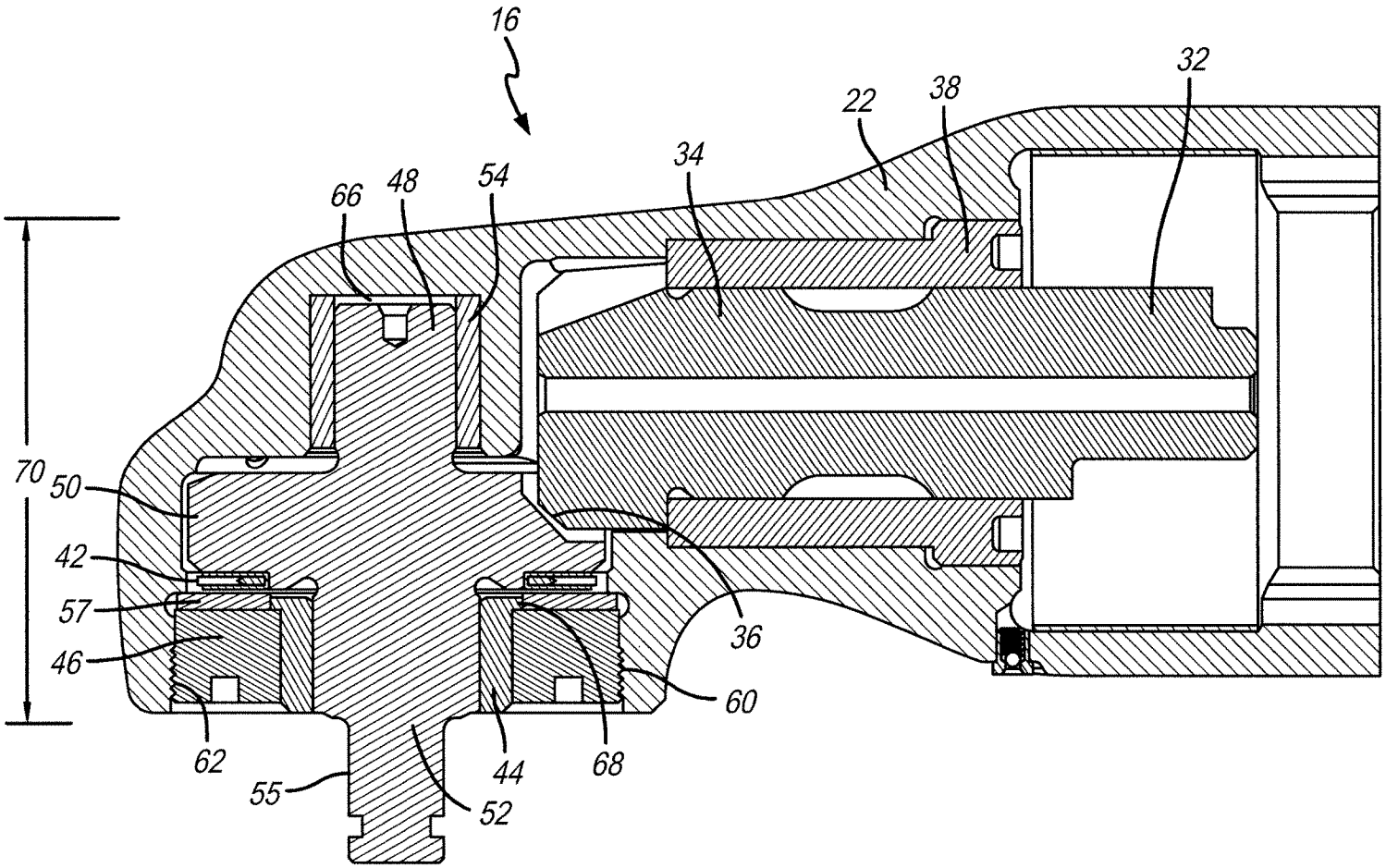
FIG. 2 PRIOR ART
FIG. 2 is a side cross-sectional view of a PRIOR ART portion of a power tool.
Figure 3:
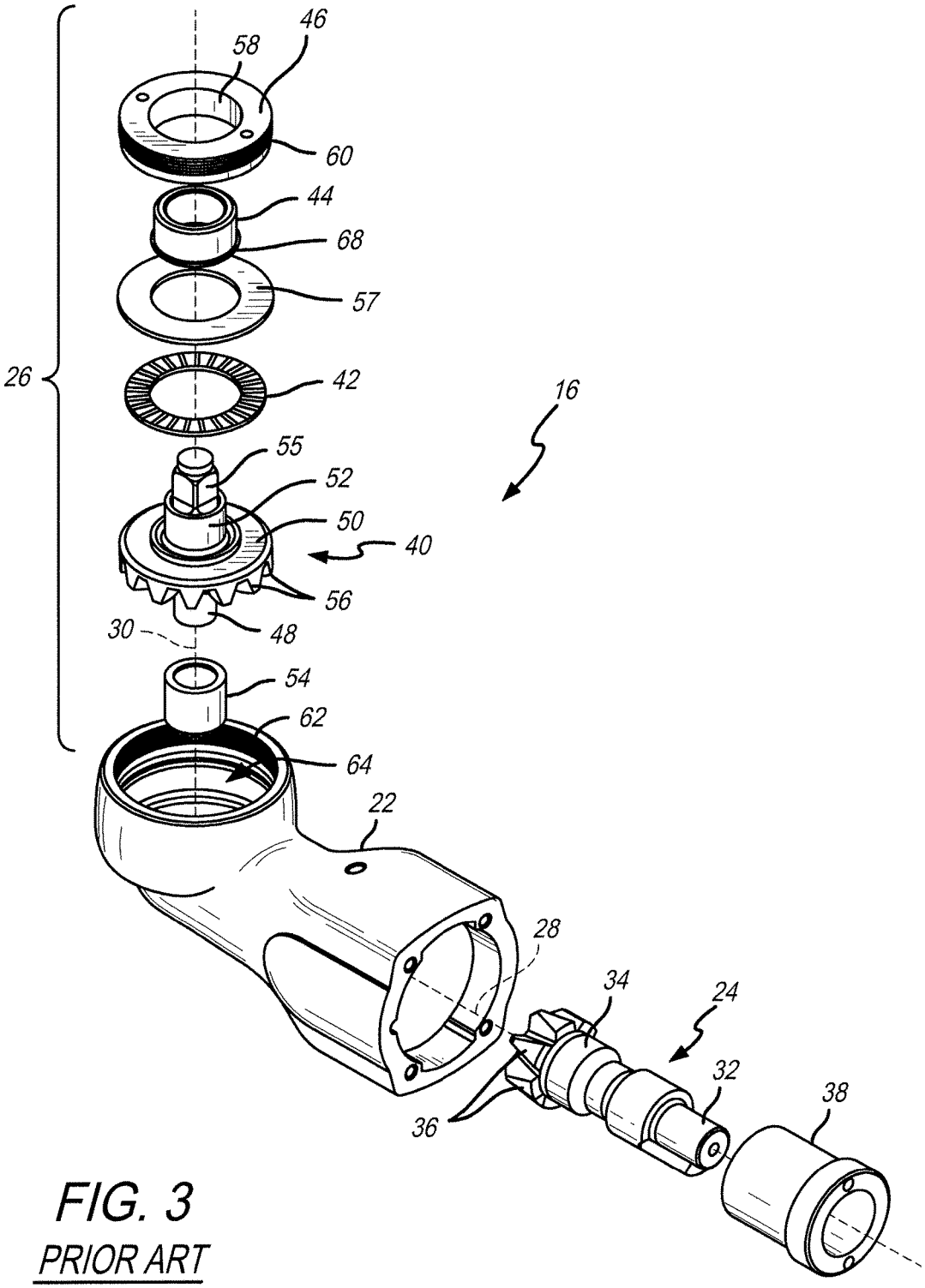
FIG. 3 PRIOR ART
FIG. 3 is a perspective exploded view of the PRIOR ART portion of the power tool.

Side cross-sectional and perspective exploded views of angled head 16 of power tool 10 are shown in PRIOR ART FIGS. 2 and 3. Angled head 16 illustratively includes an angled housing 22, a pinion shaft 24, and a gear assembly 26. Angled housing 22 also defines first and second non-parallel axes 28, 30. It is appreciated that first axis 28 may be perpendicular to second axis 30. In other embodiments (not shown), first axis 28 may be at an acute or obtuse non-parallel angle to second axis 30. Pinion shaft 24 has a first end 32 and a second end 34. First end 32 is adapted to be coupled to the motor of the power tool 10 making pinion shaft 24 rotatable under the influence of a drive force from the motor within angled housing 22 about first axis 28. A bearing 38 is provided for supporting pinion shaft 24 within angle housing 22 for rotation about first axis 28. Second end 34 of pinion shaft 24 includes pinion teeth 36 for engaging gear assembly 26. Illustratively, gear assembly 26 includes a bevel gear 40, a thrust bearing 42, an axial bearing 44, and a retaining nut 46. Bevel gear 40 includes an upper shaft 48, toothed portion 50, and output spindle 52. Upper shaft 48 is supported for rotation about second axis 30 with a bushing 54. Toothed portion 50 is located between upper shaft 48 and output spindle 52, and includes bevel teeth 56. Illustratively, bevel teeth 56 are sized and shaped to meshingly engage pinion teeth 36 of pinion shaft 24. Output spindle 52 may have a standard square drive 55. It is also appreciated that the output spindle may have any variety of alternative output structures such as a female hex used in quick change applications or a male spline, for example. Retaining nut 46 includes an inner surface 58 and an outer surface 60. Illustratively, outer surface 60 may be threaded for engagement with inner surface 62 of angled housing 22 to secure retaining nut 46 to angled housing 22. Inner surface 58 surrounds axial bearing 44 and output spindle 52.

Angled head 16 transmits rotation of pinion shaft 24 about fist axis 28 to rotation of output spindle 52 about second axis 30. To do this, pinion teeth 36 of pinion shaft 24 meshingly engage bevel teeth 56 of bevel gear 40. As pinion shaft 24 rotates about first axis 28, pinion teeth 36 drive rotation of output spindle 52. A head height dimension 70 of angled head 16 is illustrated in PRIOR ART FIG. 2. Head height dimension 70 is illustratively the axial distance from the top of angled head 16 to the beginning edge of the square drive feature 55 of output spindle 52. It is appreciated that head height dimension 70 is reduced so that angled head 16 may fit into small spaces.

Figure 4:
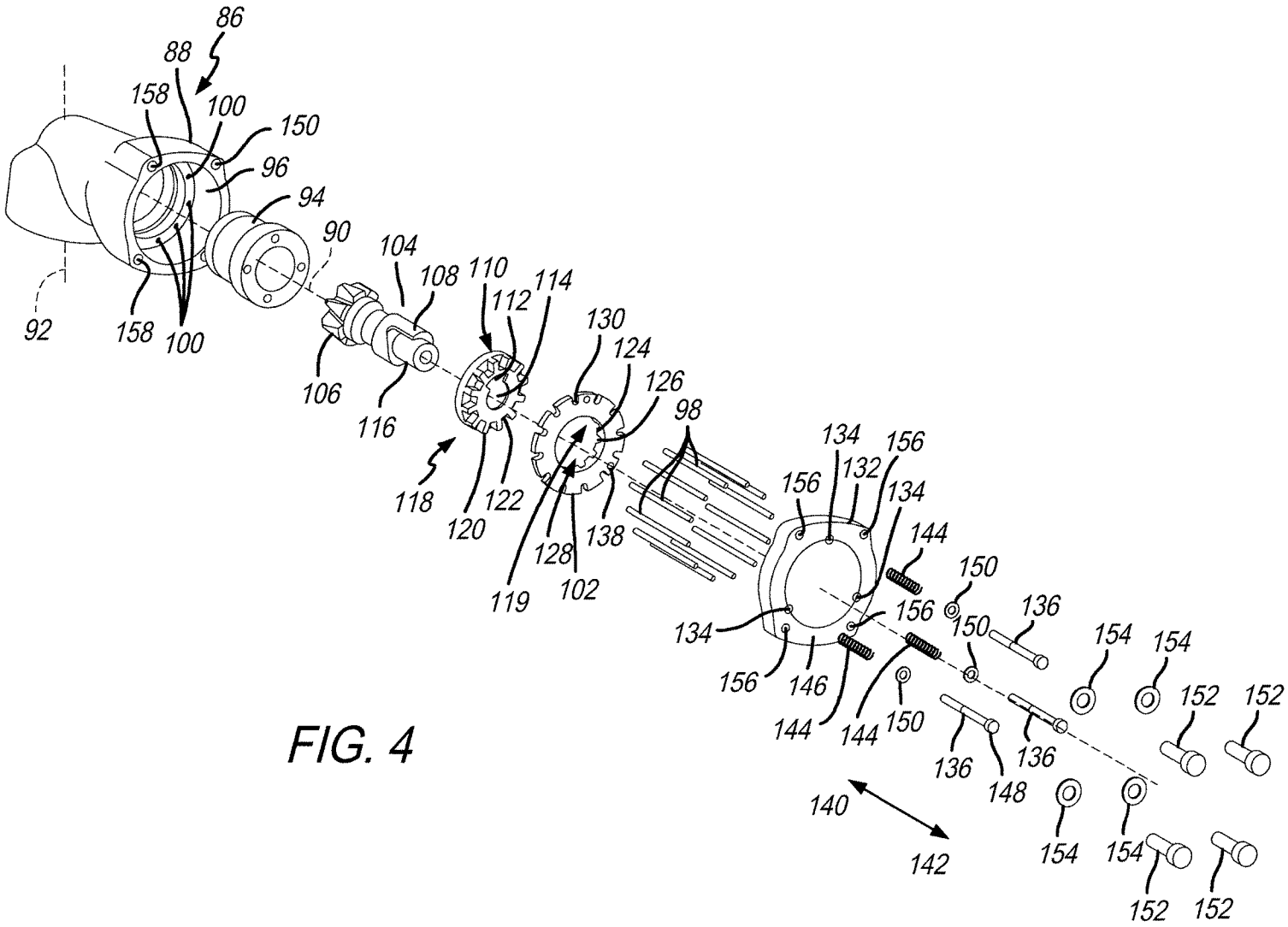
FIG. 4 is a perspective exploded view of an angled head portion of the power tool.

A perspective-exploded view of an alternative angled head 86 of power tool 10 is shown in FIG. 4. As depicted, angled head 86 may include angled housing 88 that defines first and second non-parallel axes 90 and 92 similar to non-parallel axes 28 and 30 previously discussed. Also in this illustrative embodiment, first axis 90 is oriented substantially perpendicular to second axis 92. It is appreciated, however, that in other embodiments (not shown), first axis 90 may be at an acute or obtuse non-parallel angle to second axis 92. Bushing 94, similar to bearing 38 shown in PRIOR ART FIG. 3 is configured to be fitted within opening 96 of angled housing 88. It is appreciated that both bushing 94 and angled housing 88 may be modified to receive the plurality of pins 98. Illustratively, angled housing 88 may include pin bores 100, all configured to receive portions of pins 98. Also illustratively, pin bores 100 may be positioned concentrically around the interior of angled housing 88 to accommodate the concentric positioning of the plurality of pins 98 which to assist defining the path of travel of upper dog ring 102 while limiting its ability to rotate about axis 90.

A pinion 104 includes pinion teeth 106 similar to pinion teeth 36 from PRIOR ART FIG. 3 configured to engage beveled teeth 56 to rotate the illustrative standard output spindle 52. It is appreciated that the lock mechanism described herein may be used with standard pinion 24 as previously shown and described. Pinion 104 may further include a key portion 108 configured to be received in key slot 112 of lower dog ring 110. A bore 114 connected to key slot 112 in lower dog ring 110 is configured to receive post portion 116 of pinion 104. Lower dog ring 110 also includes a castellated surface 118 made up of alternating pluralities of teeth 120 and depressions 122 located about the peripheral face of one side of lower dog ring 110. These teeth 120 and depressions 122 are configured to engage corresponding teeth 124 and depressions 126 on castellated surface 119 of upper dog ring 102.

A bore 128 is located in upper dog ring 102 and configured to receive post portion 116 of pinion 104. It is appreciated that unlike the key slot 112 in lower dog ring 110, bore 128 is not necessarily configured to inhibit rotational movement of post portion 116. Rather, bore 128 is illustratively figured to allow upper dog ring 102 to move and engage lower dog ring 110. Pins 98 are configured to each be received in one of a plurality of pin slots 130 illustratively deposed about the outer periphery of upper dog ring 102. It is contemplated that upper dog ring 102 can move axially along the path of axis 90 but does not rotate about axis 90, and pins 98 facilitate this limited movement. A cap 132 is illustratively configured to sandwich the aforementioned components into angled head 86. Bores 134 are disposed through cap 132 and configured to receive illustrative fasteners 136 that extend through and secure onto upper dog ring 102. In the illustrative embodiment, a plurality of fastener receivers 138 are disposed adjacent the periphery of upper dog ring 102 opposite the castellated surface 119 of upper dog ring 102. Accordingly, movement of fasteners 136 in either direction 140 or 142 causes upper dog ring 102 to move in those same directions as well. A plurality of springs 144 are configured to engage surface 146 of cap 132 and head 148 of fasteners 136 to provide a bias force on upper dog ring 102 in direction 142. In this illustrative configuration, upper dog ring 102 is configured to be separated from lower dog ring 110 unless a force acts on to it in direction 140, against the bias of springs 144, to engage the same together. Illustrative washers 150 may abut fastener heads 148 in a conventional manner as shown to assist engagement with springs 144 and create the bias in direction 142. Fasteners 152 illustratively with corresponding washers 154, may dispose through bores 156 and into corresponding fastener receivers 158 to secure cap 132 onto angled head 86.

Figure 5:
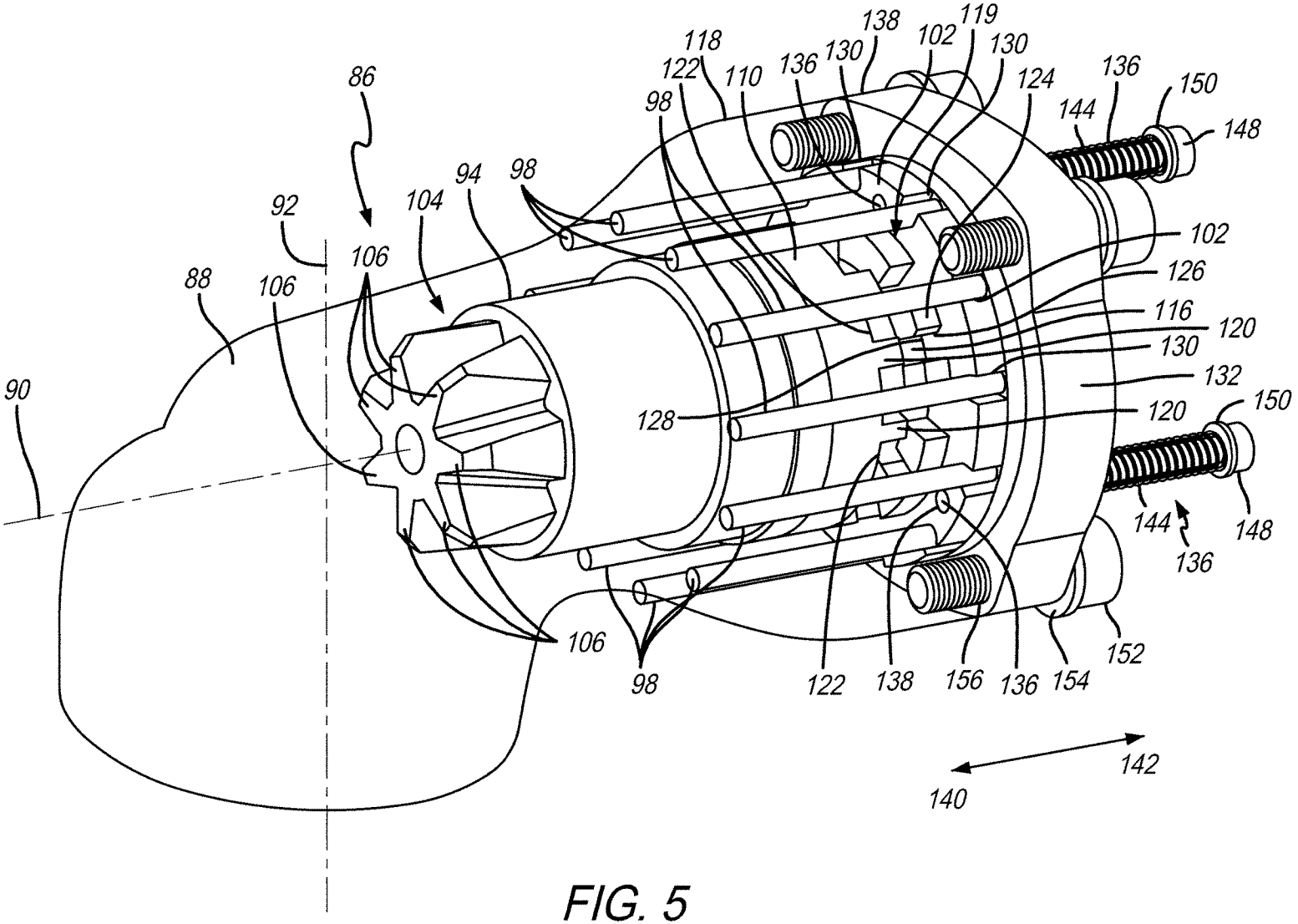
FIG. 5 is a perspective-ghost view showing the interior structures of the angled head portion of the power tool.

A perspective-ghost view of angled head 86 showing the interior structures is shown in FIG. 5. This view, in contrast to the exploded view in FIG. 4, shows the previously described components in cooperating working arrangement. Here, pinion 104 extends from bushing 94, lower dog ring 110, and upper dog ring 102. In particular, this view shows post portion 116 extending back through opening 128 in upper dog ring 102. This view also shows teeth 106 extending from bushing 94 and configured to engage teeth 56 as previously discussed. Pins 98 are shown positioned about the circular periphery of the internal structures and aligned parallel with axis 90. (See, also, FIG. 9). Each of pins 98 are also fitted within pin slots 130 of upper dog ring 102. This view also demonstrates how castellated surface 118 of lower dog ring 110 is separated from castellated surface 119 of upper dog ring 102. This is evident by the fact that teeth 120 and depressions 122 of lower dog ring 110 are not engaged with corresponding teeth 124 and depressions 126 of upper dog ring 102. This means that pinion 104 is free to rotate with respect to upper dog ring 102. It is appreciated from this view that lower dog ring 110 may be of smaller diameter when compared to the diameter of upper dog ring 102. This allows lower dog ring 110 to rotate with pinion 104 by virtue of key 108 in key slot 112 in those structures without interfering with pins 98. This view also shows fasteners 136 with springs 144 disposed thereabout and engaging washers 150 against fastener heads 148. This view also shows fasteners 136 engaged in fastener receiver 138 in upper dog ring 102. Springs 136 bias in direction 142 keeping upper dog ring 102 separated from lower dog ring 110. Lastly, fasteners 152 are disposed through washers 154 and bores 156, in cap 132 securing same to angled housing 88.

Figure 6:
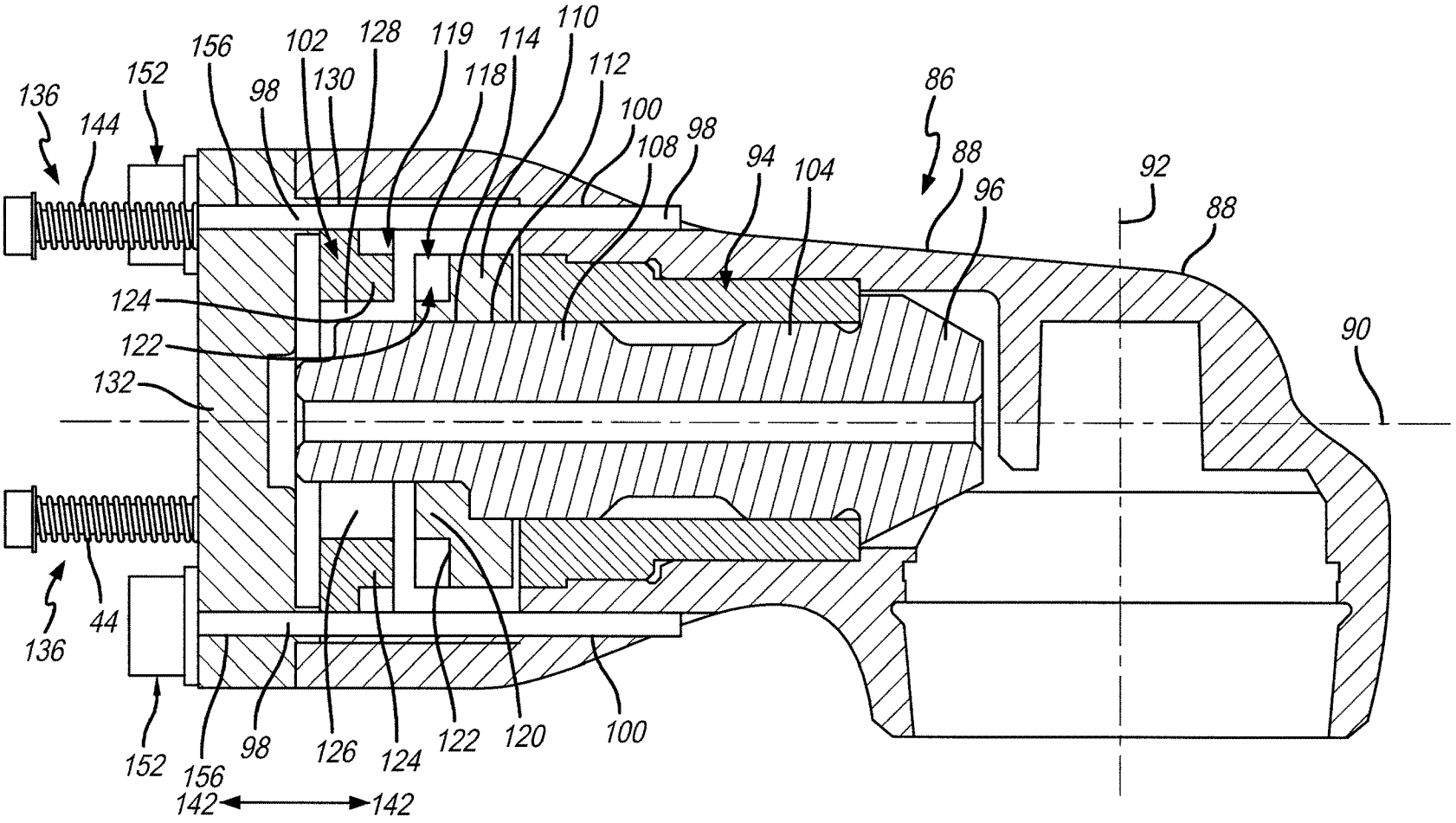
FIG. 6 is a side view of the angled head.

A side cross-sectional view of angled housing 88 with upper dog ring 102 separated from lower dog ring 110 is shown in FIG. 6. It is appreciated from this view how pinion 104 is disposed in opening 96 of angled housing 88. Also shown is bushing 94 surrounding pinion 104. Key 108 is shown disposed through key slot 112 of lower dog ring 110. Pinion 104 is also shown disposed through opening 114 of lower dog ring 110 as well as bore 128 of upper dog ring 102. Pins 98 are also shown disposed through bores 156 of cap 132 as well as pin bores 100 in angle housing 88, and pin slots 130 in upper dog ring 102. This view further illustrates how lower dog ring 110 is a smaller diameter than upper dog ring 102 so that lower dog ring 110 may rotate along with pinion 104 so long as lower dog ring 110 is spaced about from upper dog ring 102. To that end, castellated surface 118 of lower dog ring 110 is shown facing castellated surface 119 of upper dog ring 102. In this embodiment, a depression 122 of lower dog ring 110 is configured to receive a tooth 124 from upper dog ring 102. Conversely, a tooth 120 of lower dog ring 110 is configured to engage a corresponding depression 126 in upper dog ring 102. But as shown here without engagement of upper dog ring 102 with lower dog ring 110, pinion 104 is free to rotate. Fasteners 136 with springs 144 pushing there against in direction 142 maintains the disengagement between upper dog ring 102 and lower dog ring 110. Lastly, fasteners 152 are shown securing cap 132 to angled housing 88.

Figure 7:
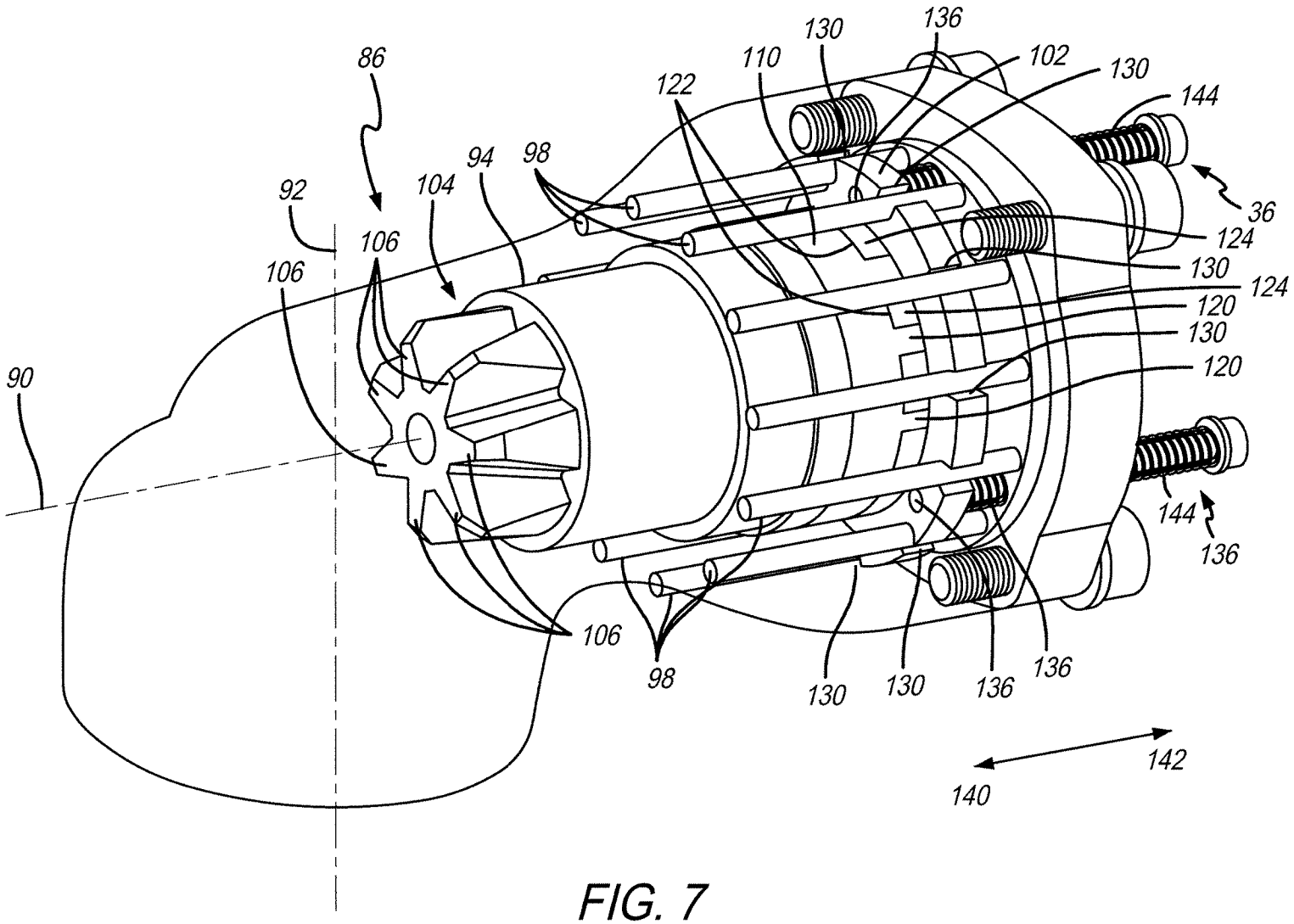
FIG. 7 is another perspective ghost view of the angled head.

Another perspective ghost view of angled head 86 is shown in FIG. 7. This view is similar to that shown in FIG. 5 with pinion 104 extending from bushing 94, lower dog ring 110, and upper dog ring 102. A difference between FIGS. 5 and 7 is that FIG. 7 shows upper dog ring 102 engaged with lower dog ring 110 rather than being separated. As shown, each of the teeth 124 of upper dog ring 102 fits in a depression 122 in lower dog ring 110. The reverse is also true where each of teeth 120 of lower dog ring 110 fits into each depression 126 of upper dog ring 102. This creates a secure mating or meshing between the two structures. Furthermore, because upper dog ring 102 is sliding along posts 98 and pin slots 130 upper dog ring 102 does not rotate about access 90. And because lower dog ring 110 is rotatable along with bushing 94 and pinion 104, when engaged with upper dog ring 102 lower dog ring 110 can no longer rotate. This keeps teeth 106 from rotating which will ultimately prevent output spindle 52 from rotating either. It is further evident from this view how fasteners 136 move against the bias of springs 144 in direction 140 to push upper dog ring 102 against lower dog ring 110. Attachment of fastener 136 onto lower dog ring 102 is clearly visible in this view.

Figure 8:
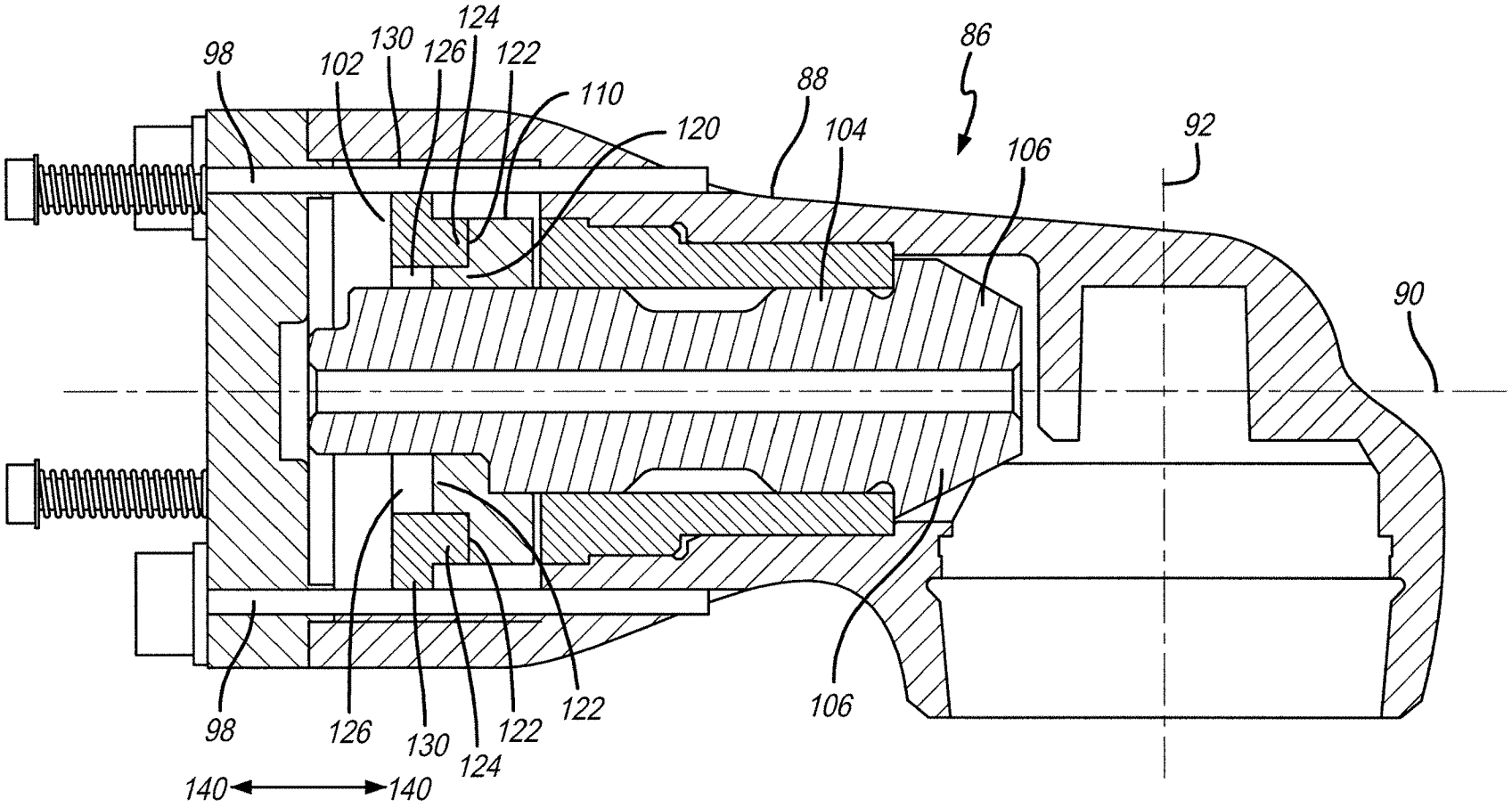
FIG. 8 is a cross-sectional view of the angled head.

A cross-sectional view of angled housing 88 of angled head assembly 86 with upper dog ring 102 engaged with lower dog ring 110 is shown in FIG. 8. This view is similar to that shown in FIG. 6 with the exception of engagement between the upper and lower dog rings 102 and 110. This view further depicts how teeth 124 of upper dog ring 102 fits into depressions 122 of upper dog ring 110. Likewise, teeth 120 of lower dog ring 110 fits into depressions 126 of upper dog ring 102. Because pins 98 fit into pin slots 130 of upper dog ring 102 has shown, it has no ability to rotate which means lower dog ring 110 cannot rotate which means that key 108 on pinion 104 is held in place keeping same from rotating which therefore keeps gear teeth 106 from rotating.

Figure 9:
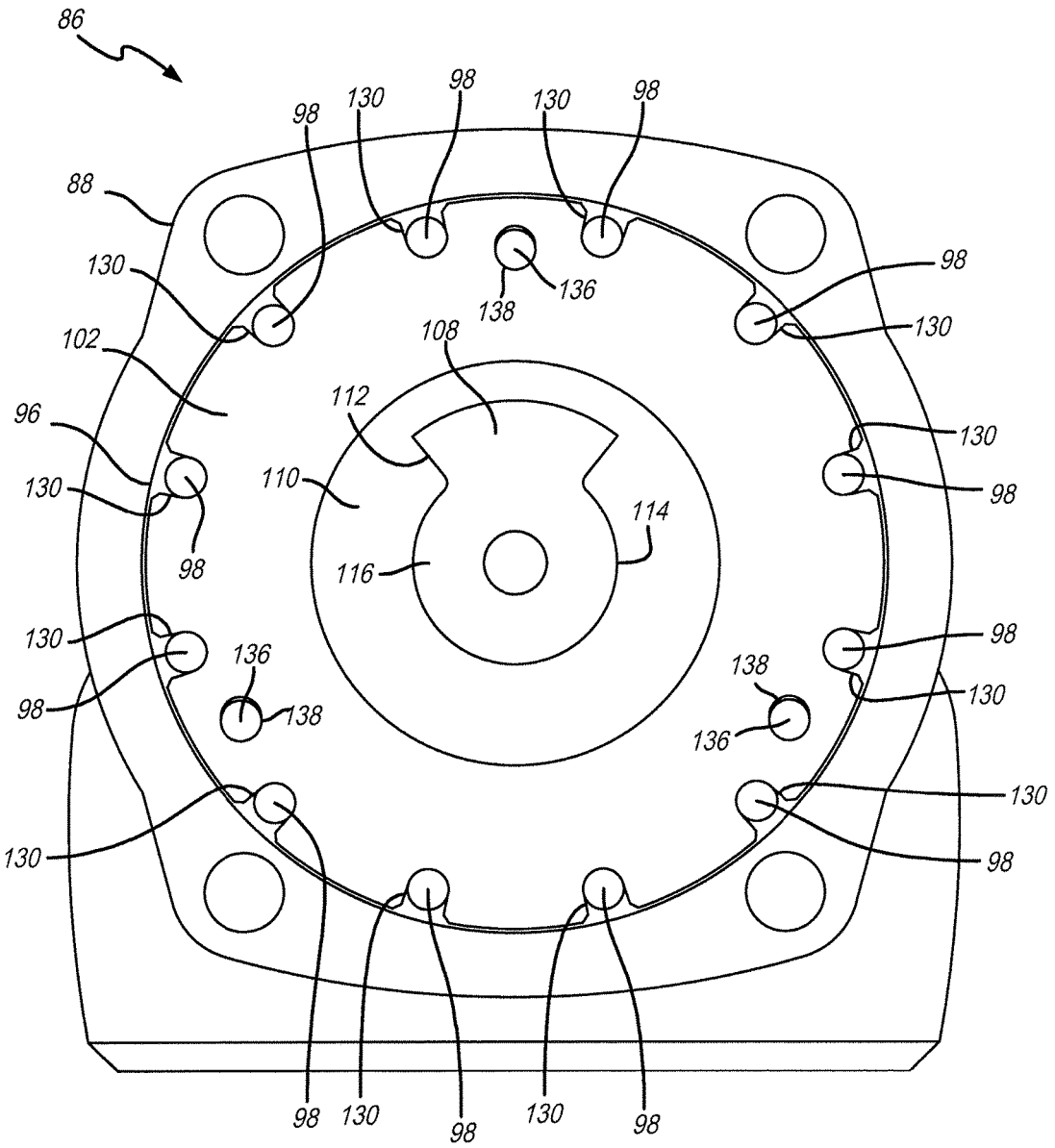
FIG. 9 is a cross-sectional view of a portion of the angled head.

A cross-sectional view of angled head assembly 86 is shown in FIG. 9. This view depicts the positioning of upper dog ring 102 with respect to opening 96 and angled head 88. As shown, key 108 and shaft 116 of pinion 104 (see also FIG. 4) fits into key slot 112 and bore 114 of lower dog ring 110. Pins 98 are shown positioned concentrically around the periphery of upper dog ring 102 and pin slots 130 to keep upper dog ring 102 from rotating. Fastener receivers 138 each receive fastener 136 which linearly moves upper dog ring 102 as previously discussed.

Figure 10:
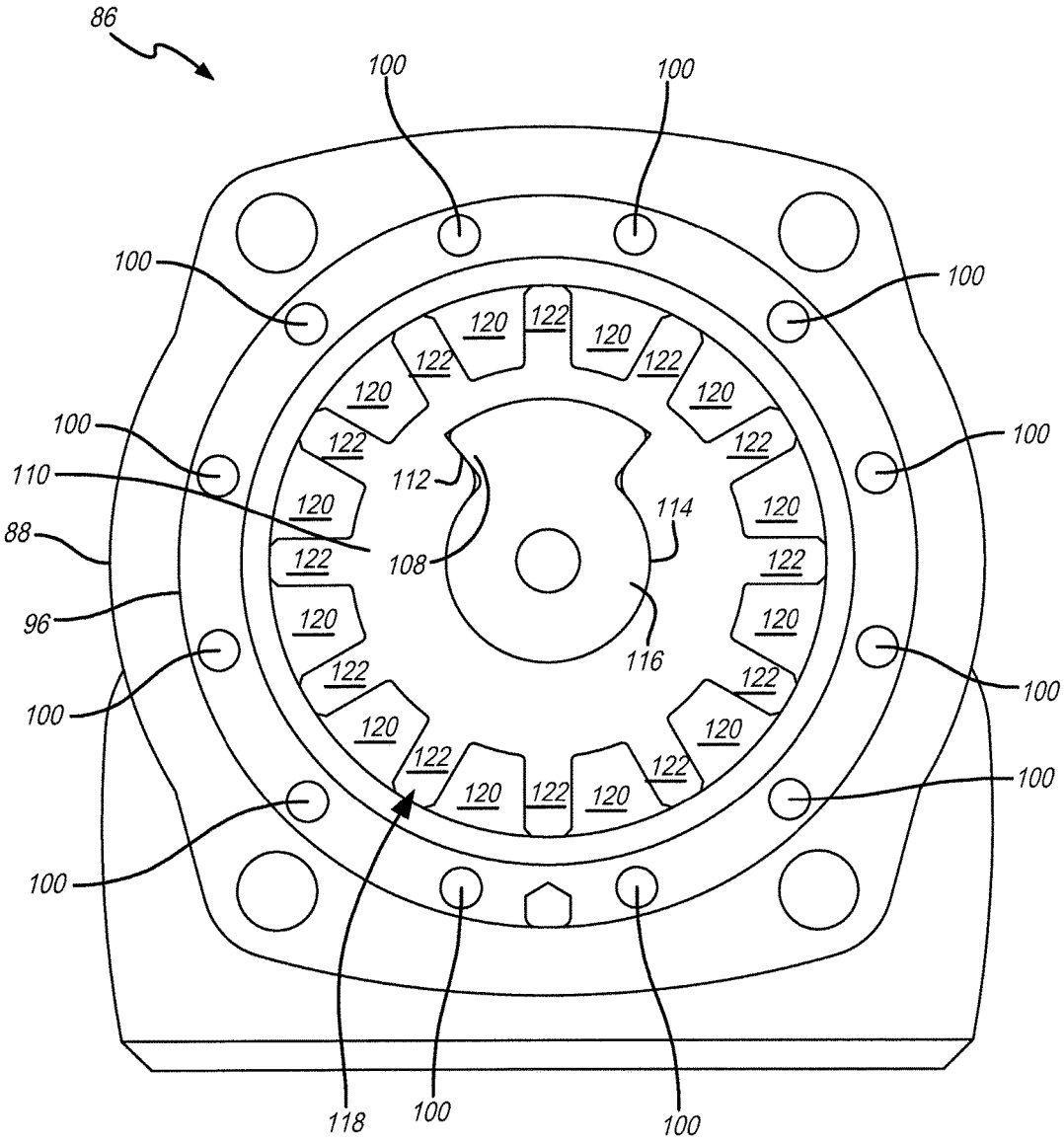
FIG. 10 is another cross-sectional view of the angled head.

Another cross-sectional view of angled head assembly 86 is shown in FIG. 10. This view shows pin bore 100 located in opening 96 and angled housing 88. It is appreciated that bores 100 receive pins 98. This view also shows lower dog ring 110 and how it connects with pin 104 via post 116 and key 108 located in bore 114 and key slot 112, respectively. This view further shows the escalated surface 118 of lower dog ring 110 with the teeth 120 and depressions 122.

Figure 11:
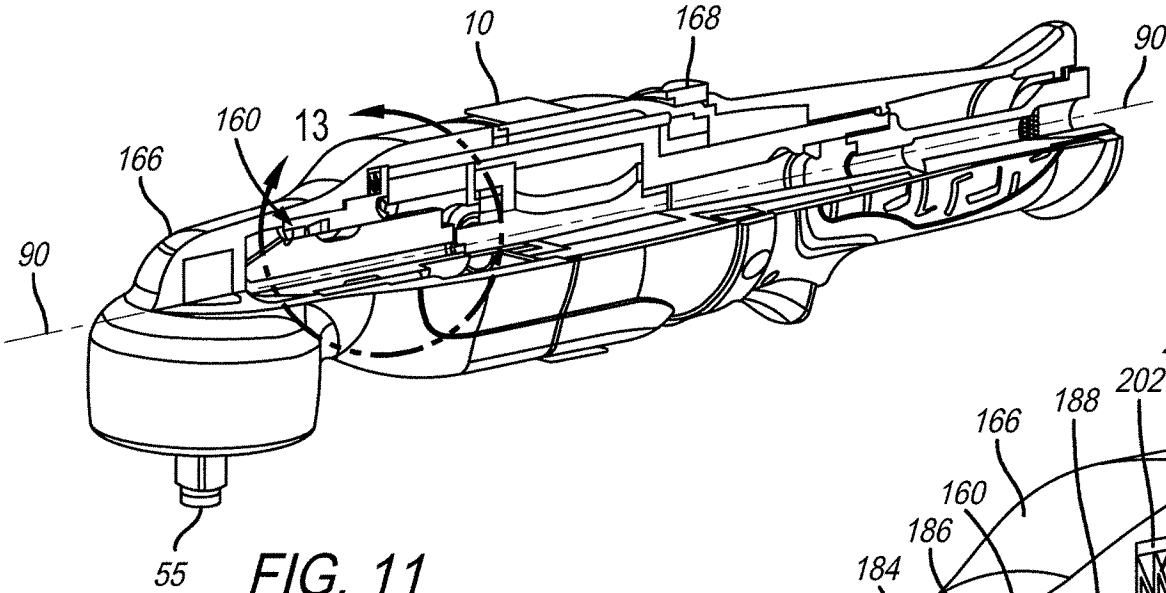
FIG. 11 is a partial cross-sectional view of another illustrative embodiment of a power tool.

Another illustrative embodiment of the present disclosure discloses an alternate method of locking output spindle 52 when wanting to use power tool 10 as a wrench. The partial cross-sectional view of power tool 10 in FIG. 11 shows an alternative lock mechanism 160 that is fitted in alternate angled head 166. In this embodiment a selector ring 168 is located about the periphery of tool 10, illustratively as shown. Selector ring 168 is traditionally configured to serve the functions of selecting to rotate spindle 52 (see, also, PRIOR ART FIG. 3) in either forward or reverse directions. In this embodiment it also serves the function of selecting to lock spindle 52 in an unmovable position.

Figure 12:
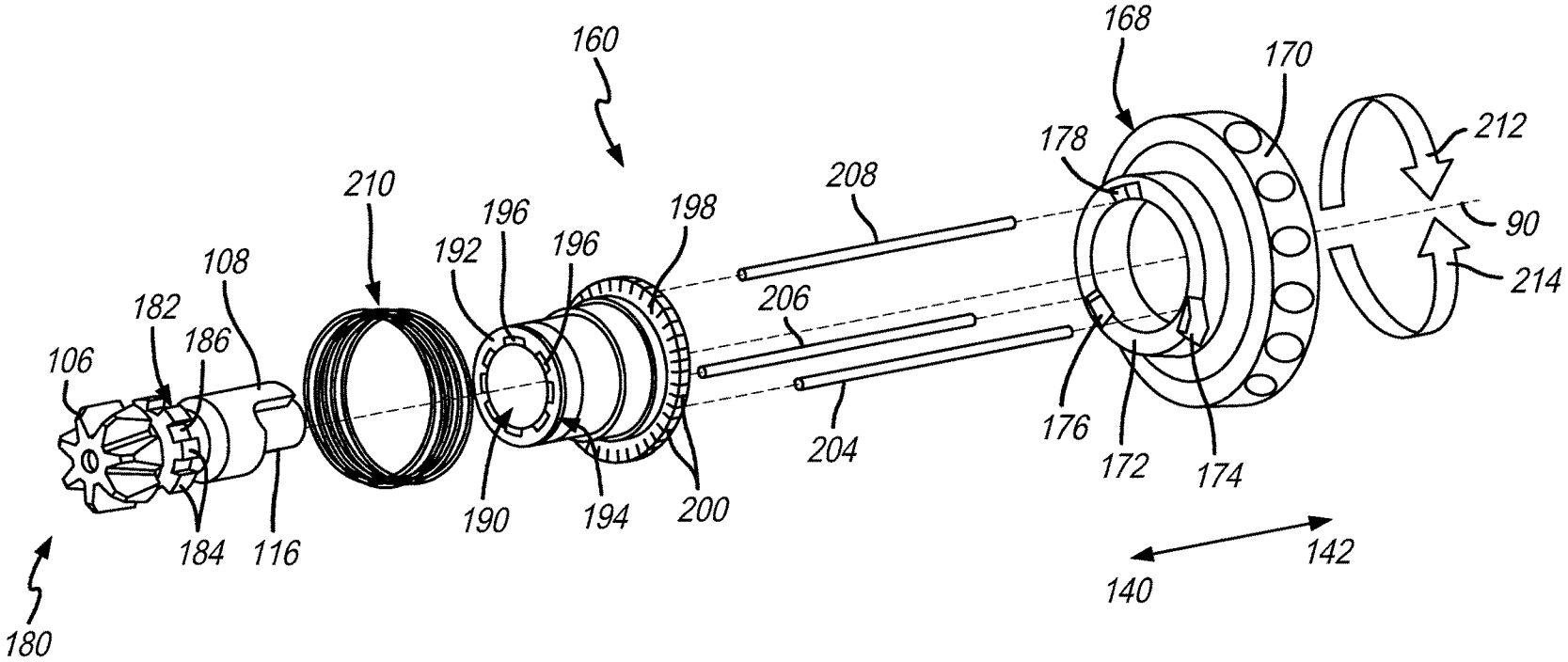
FIG. 12 is an exploded perspective view of a lock mechanism portion of the power tool FIG. 11.

An exploded view of lock mechanism 160 is shown in FIG. 12. In this embodiment, selector ring 168 is configured to rotate about axis 90 of power tool 10. Outer surface 170 of selector ring 168 may be textured or have other tactile features to assist in rotating same between the forward, reverse, and lock modes. In the illustrative embodiment, selector ring 168 further includes a face 172 that is illustratively perpendicular to outer surface 170 and is configured to include ramp surfaces 174, 176, and 178. These ramp surfaces are oriented transverse to longitudinal axis 90 of power tool 10 and each is configured to ramp upwards towards alternate angled head 166. On the opposite side is pinion 180 that includes teeth 106 similar to the prior embodiment. Also included is key 108 on shaft portion 116 like pinion 104. A distinguishing characteristic is the external dog features 182 illustratively located between gear teeth 106 and shaft 116 on pinion 180. Dog features 182 include teeth 184 and cavities 186 that extend outwardly from pinion 180 transverse to axis 90. A shuttle bushing 188 has a pinion bore 190 disposed there through configured to receive shaft 116 of pinion 180. On forward surface 192 of shuttle bushing 188 there is an internal dog feature 194 including a plurality of concentrically placed internal recesses 196 configured to receive teeth 184 of pinion 180. In contrast to the prior embodiment, despite having the existence of key 108, bore 190 is configured to receive both shaft 116 and key 108. This is because shuttle bushing 188 does not rotate with respect to pinion 180. Also in contrast, shuttle bushing 188 includes a flange portion 198 with an external spline feature 200 located about the periphery of flange 198. External spline feature 200 is illustratively configured to engage a plurality of corresponding internal splines 202 formed in the interior of angle head 166 (see, also FIG. 13). Mating between external spline features 200 and internal splines 202 help keep shuttle bushing 188 in place and nonrotatable with respect to pinion 180. Lock mechanism 160 further includes push rods 204, 206, and 208 that are configured to fit onto ramp surfaces 174, 176, and 178, respectively. Push rods 204, 206, and 208 are configured to push shuttle bushing 108 in direction 140 (i.e. along longitudinal extent of axis 90) to engage the internal dog features 194 with the external dog features 182 of pinion 180. Because shuttle bushing 188 does not rotate if teeth 184 engage cavities 196, pinion 180 becomes locked in place and can no longer rotate with respect to power tool 10.

A spring 210 is configured to push against flange portion 198 of shuttle bushing 188 so that the default position of same is in a disengaged position with respect to pinion 180. Illustratively rotating selector ring 168 in direction 212 causes ramp surfaces 174, 176, and 178 to likewise move. Moving these ramp surfaces has the effect of pushing push rods 204, 206, 208 in direction 140 which are thereby pushing shuttle bushing 188 also in direction 140 so that the internal dog features of same will engage the external dog features of pinion 180 for locking the same in place. Rotating selector ring 168 in the opposite direction 214 moves ramp surfaces 174, 176, and 178 the opposite direction so no push force is being applied against push rods 204, 206, 208. Bias from spring 210 pushes shuttle bushing 188 and rods 204, 206, 208 in direction 142 while shuttle bushing 108 disengages where the internal dog feature 194 of shuttle bushing 188 disengages from external dog features 182 from pinion 180.

Figure 13:
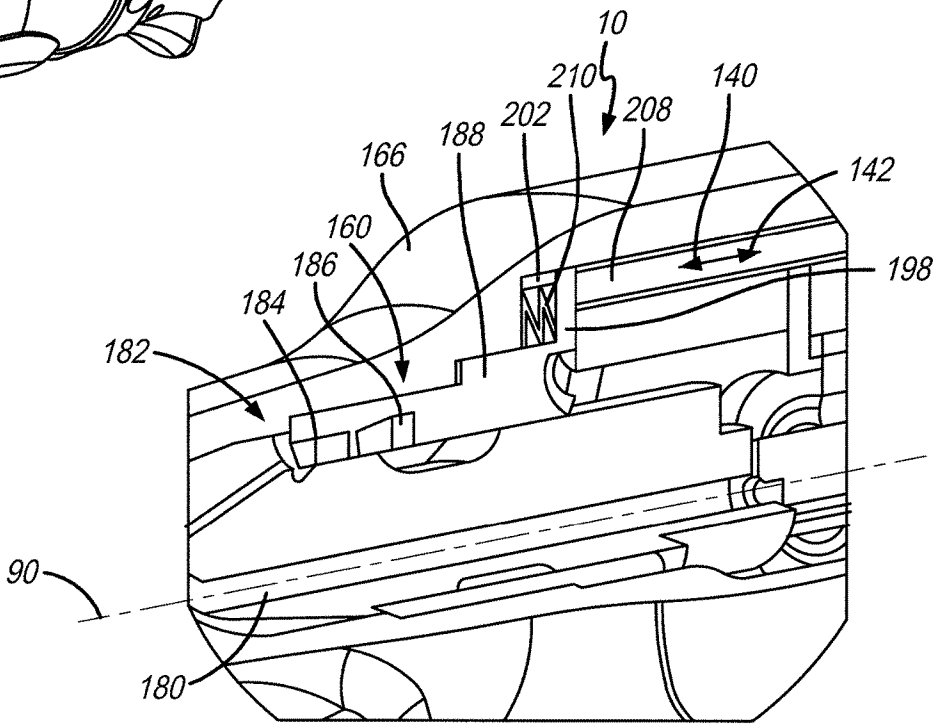
FIG. 13 is a detailed partial cross-sectional view of the power tool of FIG. 11.

A detailed partial cross-sectional view of power tool 10 showing lock feature 160 is shown in FIG. 13. As depicted, rod 208 (as well as rods 206 and 204) can be moved in direction 140 against the bias of spring 210 and against flange 198 of shuttle bushing 188 to engage teeth 184 of external dog features 182 with cavities 186 of internal dog features 194. This view also shows how internal splines 202 on the interior of housing 166 engages external spline features 200 when shuttle bushing 188 to keep the same from rotating. It is appreciated that when the external dog features 182 engage the internal dog features 184—pinion 180 can no longer rotate. To release pinion 180 and allow rotation, push rods 204, 206, and 208 simply have to move in direction 142 (which is the function of selector ring 168). In this instance spring 210 will push against flange portion 198 of shuttle bushing 188 to move same in direction 142 thereby releasing external dog features 182 on pinion 180 from internal dog features 194 of shuttle bushing 188. The effect of this is pinion 180 is, again, able to freely rotate.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

The invention claimed is:

1. A power tool comprising:

a motor housing;

an angled head that includes a rotatable output spindle and extends from the motor housing;

wherein the motor housing extends longitudinally along a first axis and the rotatable output spindle of the angled head extends longitudinally along a second axis located non-parallel to the first axis;

a pinion located in the angled head and has a first end portion and a second end portion;

wherein the first end portion of the pinion is coupled to a drive force on the first axis and the second end portion includes a plurality of gear teeth that rotate about the first axis to rotate the rotatable output shaft that extends longitudinally along the second axis;

a bushing located in the angled head;

wherein the bushing supports the pinion;

at least one pin located in the angled head;

a first ring coupled to the pinion and rotatable about the first axis with the pinion;

a second ring that engages, and is movable longitudinally along the first axis relative to, the at least one pin;

wherein the second ring is not rotatable about the first axis;

wherein the first ring includes a castellated surface having alternating pluralities of teeth and depressions;

wherein the second ring includes a castellated surface having alternating pluralities of teeth and depressions;

wherein the second ring is movable toward and away from the first ring along the first axis;

wherein the pluralities of teeth and depressions of the second ring selectively engage the pluralities of teeth and depressions of the first ring when the second ring is moved toward and engages the first ring;

wherein engagement between the first and second rings prevents the first ring from rotating with respect to the first axis which prevents the pinion from rotating which prevents the rotatable output spindle from rotating;

wherein the pluralities of teeth and depressions of the second ring selectively disengage the pluralities of teeth and depressions of the first ring when the second ring is moved away from and disengages the first ring; and wherein disengagement between the first and second rings allows the first ring to rotate with respect to the first axis which allows the pinion to rotate which allows the rotatable output spindle to rotate.

2. The power tool of claim 1, wherein the at least one pin is a plurality of pins, wherein each of the plurality of pins is located concentrically about the first axis and extend longitudinally parallel to the first axis, wherein the second ring includes a plurality of pin slots each located about the second ring and each of the plurality of pins is located in one of the plurality of pin slots.

3. The power tool of claim 1, wherein the power tool is a right-angle impact tool.

4. The power tool of claim 1, wherein the motor housing supports a pneumatic motor.

5. The power tool of claim 1, wherein the first axis is oriented perpendicular to the second axis.

6. The power tool of claim 1, wherein the pinion includes a key at the second end portion configured to engage a key slot on the first ring so the first ring will rotate with the pinion when the pinion rotates.

7. The power tool of claim 1, further comprising a cap configured to secure onto the angled head opposite the output spindle.

8. The power tool of claim 1, wherein the first ring has a smaller diameter than the second ring.

9. The power tool of claim 1, wherein at least one second pin is coupled to the second ring to move the second ring longitudinally along the first axis relative to the at least one pin.

10. A power tool comprising:

a motor housing;

an output head that includes a rotatable output spindle and extends from the motor housing;

wherein the motor housing extends longitudinally along a first axis;

a pinion located in the output head;

wherein the pinion is coupled to a drive force, and rotates about the first axis to rotate the rotatable output shaft;

at least one pin located in the output head;

a first ring coupled to the pinion and rotatable about the first axis with the pinion;

a second ring that engages, and is movable longitudinally along the first axis relative to, the at least one pin;

wherein the second ring is not rotatable about the first axis;

wherein the second ring is movable toward and away from the first ring along the first axis;

wherein the second ring is selectively engagable with the first ring;

wherein engagement between the first and second rings prevents the first ring from rotating with respect to the first axis which prevents the pinion from rotating which prevents the rotatable output spindle from rotating; and wherein disengagement between the first and second rings allows the first ring to rotate with respect to the first axis which allows the pinion to rotate which allows the rotatable output spindle to rotate.

11. The power tool of claim 10, wherein the rotatable output spindle extends longitudinally along a second axis located perpendicular to the first axis.

12. The power tool of claim 10, wherein the first ring includes a castellated surface having alternating pluralities of teeth and depressions.

13. The power tool of claim 12, wherein the second ring includes a castellated surface having alternating pluralities of teeth and depressions.

14. The power tool of claim 13, wherein the pluralities of teeth and depressions of the second ring selectively engage the pluralities of teeth and depressions of the first ring when the second ring is moved toward and engages the first ring.

15. A power tool comprising:

a motor housing;

an angled head that includes a rotatable output spindle and extends from the motor housing;

wherein the motor housing extends longitudinally along a first axis and the rotatable output spindle of the angled head extends longitudinally along a second axis located non-parallel to the first axis;

a pinion located in the angled head and having a first end portion and a second end portion;

wherein the first end portion of the pinion is coupled to a drive force on the first axis and the second end portion includes a plurality of gear teeth that rotate about the first axis to rotate the rotatable output shaft that extends longitudinally along the second axis;

a selector located on the exterior of the power tool and movable to forward, reverse, and lock positions of the rotatable output spindle;

wherein the selector further includes a face located transverse to the first axis and is configured to include at least one ramp surface;

wherein moving the selector causes the at least one ramp surface to also move;

wherein the at least one ramp surface is configured to be angled towards the pinion;

wherein the pinion further includes at least one tooth that extends from the pinion;

a bushing having a bore disposed there through and configured to receive the pinion;

wherein the bushing also includes at least one recess configured to receive the at least one tooth from the pinion;

wherein the bushing is movable longitudinally along the first axis but not rotatable about the first axis;

at least one push rod configured to fit onto the at least one ramp surface on the selector and engage the bushing;

wherein movement of the selector moves the ramp which moves the at least one push rod to move the bushing to engage the pinion;

wherein when the at least one tooth on the pinion engages the at least one recess in the bushing the pinion is not able to rotate; and a spring is configured to bias against the bushing to keep the at least one tooth and the at least one recess separated when the selector has not pushed the at least one push rod against the bushing to move the bushing against the pinion.

16. The power tool of claim 15, wherein the at least one tooth is a plurality of teeth and the at least one recess is a plurality of recesses.

17. The power tool of claim 15, wherein the pinion, bushing, and at the least one push rod are longitudinally movable along the first axis.

18. The power tool of claim 15, wherein the selector is a ring configured to rotate about the first axis.

19. The power tool of claim 18, wherein rotating the selector ring in a first direction moves the at least one push rod to move the bushing against the pinion to prevent the pinion from rotating.

20. The power tool of claim 15, wherein the at least one ramp surface is a plurality of ramp surfaces, wherein the at least one push rod is a plurality of push rods wherein the plurality of push rods are configured to be moved by the plurality of ramp surfaces to move the bushing against the pinion to prevent the pinion from rotating.

* * * * *